US005103509A

United States Patent [19]

Richards

[11] Patent Number: 5,103,509

[45] Date of Patent: Apr. 14, 1992

[54] APPARATUS FOR ASSISTING PHYSICALLY DISABLED PERSONS INTO AND OUT OF A BATH

[75] Inventor: Derek J. Richards, Gloucester, England

[73] Assignee: Arjo Mecanaids Limited, Gloucester, England

[21] Appl. No.: 600,995

[22] Filed: Oct. 23, 1990

[30] Foreign Application Priority Data

Nov. 17, 1989 [GB] United Kingdom ..... 8926066

[51] Int. Cl.[5] ..... A47K 3/12

[52] U.S. Cl. ..... 4/564.1; 4/578.1

[58] Field of Search ..... 4/564, 565, 578, 579

[56] References Cited

U.S. PATENT DOCUMENTS

| | | | |
|---|---|---|---|
| 3,078,475 | 2/1963 | Turner | 4/578 X |
| 3,103,384 | 9/1963 | Zivi | 4/564 X |
| 3,123,400 | 3/1964 | Paulson . | |
| 3,256,036 | 6/1966 | Nolan | 4/564 X |
| 3,286,970 | 11/1966 | Nolan . | |
| 3,366,978 | 2/1968 | Jones | 4/578 X |
| 3,994,030 | 11/1976 | Cassell et al. . | |
| 4,013,316 | 3/1977 | Cropper . | |
| 4,091,478 | 5/1978 | Hardwick et al. | 4/578 X |
| 4,768,239 | 9/1988 | Pauley | 4/564 |

FOREIGN PATENT DOCUMENTS

| | | | |
|---|---|---|---|
| 2206007 | 1/1980 | Fed. Rep. of Germany | 4/561 |
| 3511267 | 10/1986 | Fed. Rep. of Germany . | |
| WO90/00891 | 2/1990 | PCT Int'l Appl. . | |
| 719244 | 12/1954 | United Kingdom . | |
| 1346392 | 2/1974 | United Kingdom . | |
| 2097250 | 11/1982 | United Kingdom . | |
| 2014446 | 1/1983 | United Kingdom . | |
| 2117236 | 10/1983 | United Kingdom . | |
| 2117236 | 10/1983 | United Kingdom . | |
| 2131291 | 6/1984 | United Kingdom . | |
| 2154201 | 9/1985 | United Kingdom . | |
| 2166415 | 5/1986 | United Kingdom . | |
| 2196247 | 4/1988 | United Kingdom . | |

*Primary Examiner*—Daniel M. Yasich

*Attorney, Agent, or Firm*—Young & Thompson

[57] ABSTRACT

Apparatus for assisting physically disabled persons into and out of a bath, comprises a base, suckers provided on the base for releasably gripping an inside bottom surface of the bath, a lifting column fixed to the base, a seat supported by the lifting column, and an electrically powered actuator mounted with respect to the lifting column for raising and lowering the seat relative to the base. The lifting column is in the form of a telescopic mast having a lower part fixed to the base and an upper part which can be extended and retracted relative to the lower part by the actuator. The apparatus is self-contained and can be placed in or removed from a bath at will.

10 Claims, 4 Drawing Sheets

APPARATUS FOR ASSISTING PHYSICALLY DISABLED PERSONS INTO AND OUT OF A BATH

INTRODUCTION

This invention relates to apparatus for assisting physically disabled persons into and out of a bath and, more particularly, to such apparatus which is self-contained and which can be placed in and removed from a bath at will.

Lifting devices are known for assisting physically disabled persons into and out of a bath. One such lifting device is designed to be fixed to the floor beside the bath. This has its place, but it takes up room which is often at a premium particularly in a domestic situation and has to be installed. Another such lifting device is provided on a saddle frame which fits to the side of the bath. This is often difficult to secure in place, particularly if the bath is fitted with a non-rigid bath panel, and does not fit all sizes of bath. Other known lifting devices make use of a bag or bellows device to raise and lower a seat relative to a base support. These are difficult to clean, and some draw water from the bath to extend the bellows and raise the seat with the result that any dirty water remaining in the bellows after one operation may be discharged into the bath during a subsequent operation thus constituting an infection hazard.

SUMMARY OF THE INVENTION

The present invention provides apparatus for assisting physically disabled persons into and out of a bath, comprising a base, means provided on the base for releasably gripping an inside bottom surface of a bath, a lifting column fixed to the base, a seat supported by the lifting column, and an electrically powered actuator mounted with respect to the lifting column for raising and lowering the seat relative to the base.

Preferably, the lifting column is in the form of a telescopic mast having a lower part fixed to the base and an upper part which can be extended and retracted relative to the lower part by the actuator.

In this case, advantageously, the seat is fastened to the upper mast part and means are provided to guide the seat relative to the lower mast part as the upper mast part, together with the seat, is raised and lowered relative to the lower mast part.

Preferably, the actuator is an electromechanical actuator and in this case, preferably, the actuator comprises an electric motor mounted at or adjacent to an upper end of the upper mast part and a threaded rod and nut arrangement within the mast, the threaded rod and nut being rotatable relative to one another by the electric motor.

Alternatively, the actuator could be an electrohydraulic actuator.

Preferably, the actuator is powered by a rechargeable battery pack removably mounted for recharging purposes at or adjacent to an upper end of the lifting column.

Preferably, the seat is detachable from the lifting column.

Preferably, the seat has at least one hinged side flap for extending to the side of the seat.

Preferably, the gripping means comprises suckers, and in this case, advantageously, the base is provided with two suckers and two non-gripping pads for supporting the base on the inside bottom surface of the bath. Each sucker may have a flap for releasing the sucker from gripping engagement with the bath surface and in this case the flap preferably connects a rim portion of the sucker to the base of the apparatus so that the sucker can be released from gripping engagement with the bath surface by raising the non-gripping pads clear of the bath surface.

Alternatively, the base may be provided with four suckers.

The invention will now be more particularly described, by way of example, with reference to the accompanying drawings.

DESCRIPTION OF THE PREFERRED EMBODIMENT

Figure 1:
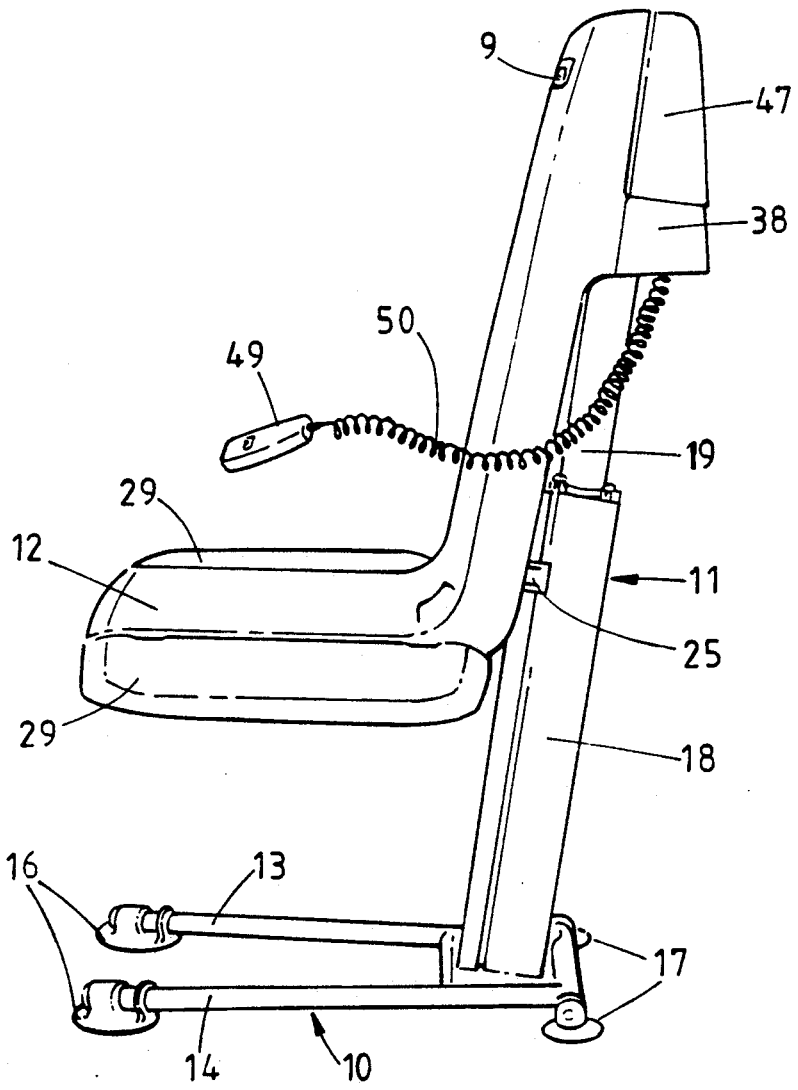
FIG. 1 is a side view of one embodiment of apparatus according to the present invention, with the mast in a raised condition.
Figure 4:
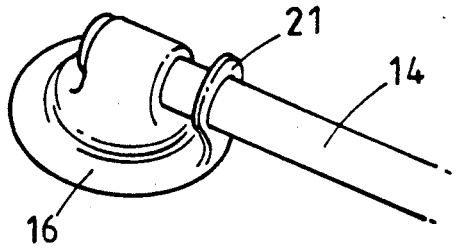
FIG. 4 is a fragmentary perspective view of one of the suckers.
Figure 2:
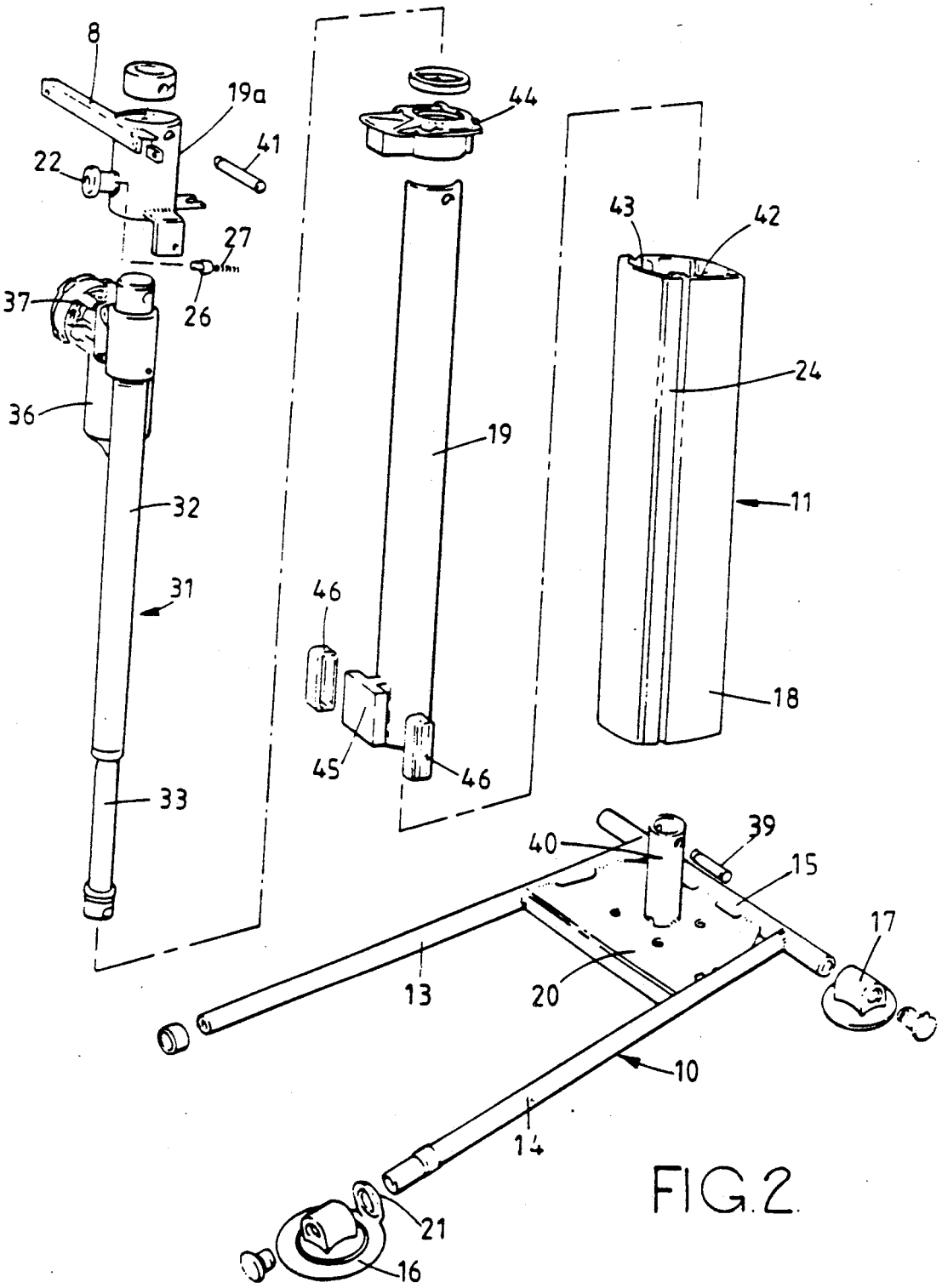
FIG. 2 is an exploded perspective view of the base and lifting column of the apparatus shown in FIG. 1, on an enlarged scale.
Figure 3:
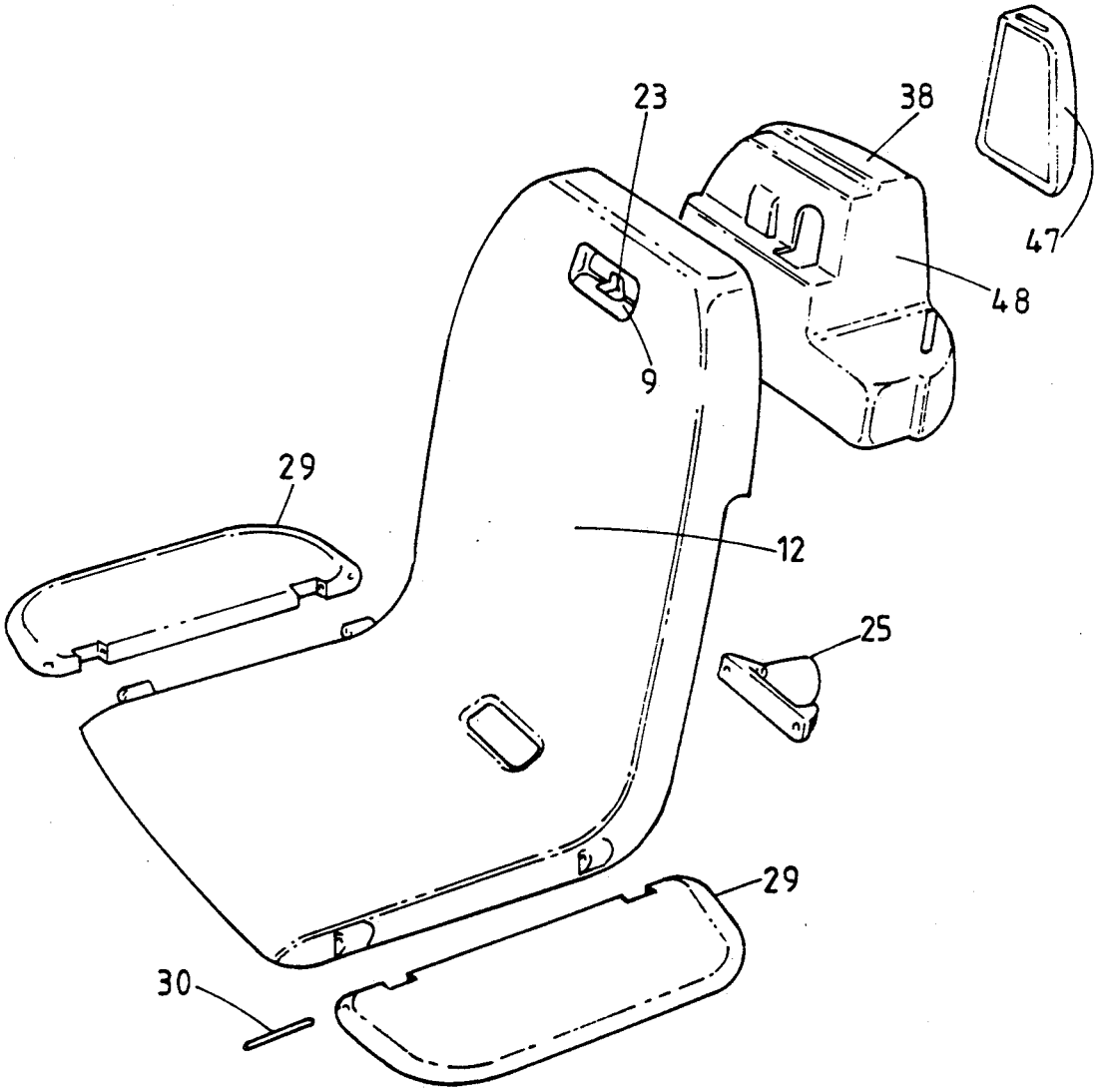
FIG. 3 is an exploded perspective view showing the seat, the battery pack, and the motor and control gear housing of the apparatus shown in FIG. 1, also on an enlarged scale.

Referring now to FIGS. 1 and 2, the apparatus shown therein comprises a base 10, a lifting column in the form of a telescopic mast 11 fixed to and upstanding from the base 10, and a seat 12 supported by the mast 11.

The base 10 comprises two spaced apart arms 13 and 14, a cross member 15 at the rear ends of the two arms 13 and 14 and a support plate 20 secured, such as by welding, between the arms 13 and 14 and the cross member 15. Two gripping members in the form of suckers 16 are mounted on the front ends of the two arms 13 and 14, respectively, and two non-gripping pads 17 are mounted on opposite ends of the cross member 15.

The suckers 16 each have a flap 21 for releasing the sucker from gripping engagement with a surface of a bath. The flap 21 is secured to or is integral with a rear portion of the rim of a respective sucker 16 and has an aperture through which a respective arm 13, 14 extends. If the base 10 is lifted at its rear end thereby raising the non-gripping pads 17 clear of the bath surface, the flaps 21 will pull on the rim of respective suckers 16 to release these from gripping engagement with the bath surface.

The non-gripping pads 17 may, if desired, be replaced by further suckers.

The mast 11 comprises a lower mast part 18 which is bolted at its lower end to the support plate 20, and an upper mast part 19 which is slidable in the lower mast part 18 for movement between a retracted position and an extended position (shown in FIG. 1).

The seat 12 has a recess 9 adjacent to its upper end to define a handle.

A collar **19*a* is connected to the upper end of the upper mast part 19 and this collar 19*a* is provided with a headed spigot 22 for supporting the upper end of the seat 12. For this purpose, the seat 12 has a slot 23 in the base of the recess 9 for receiving the headed spigot 22. In order to prevent the seat swinging away from the mast 11 as it is raised and lowered, the seat 12 is guided along the lower mast part 18. For this purpose, the lower mast part 18 has a flange 24 which extends over the entire length of the lower mast part 18 and which co-operates with a pair of spaced lugs 25 connected to the rear of the seat 12**.

In order to prevent the seat 12 from becoming unintentionally detached from the mast 11, a button 26 is slidably mounted in the spigot 22. The button 26 is urged to project from the spigot 22 by a compression spring 27. When projecting from the spigot 22, the button 26 will extend into the recess 9 in the seat 12 beyond the edge of the slot 23 and so prevent the slot 23 being lifted clear of the spigot 22. However, the seat 12 can be detached from the mast 11 at will by depressing the button 26 and raising the seat 12 to move the slot 23 clear of the spigot 22 and the lugs 25 clear of the flange 24.

The seat 12 has at least one, but preferably two, side flaps 29 which are hingedly connected to the seat by pins 30 and which, when extended sideways, will bridge any gap between the seat and the edge of a bath in a manner described hereinafter.

Figure 5:
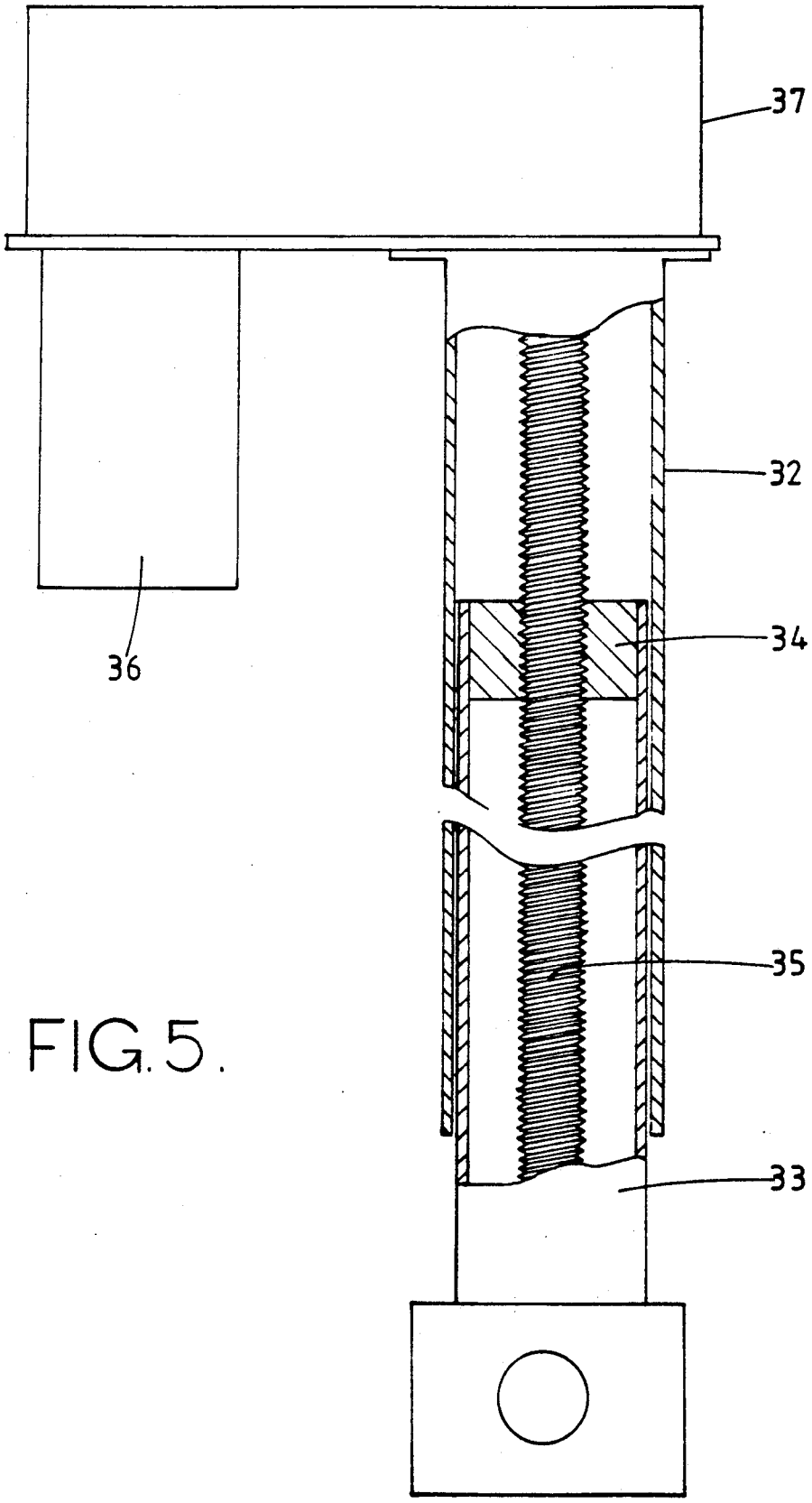
FIG. 5 is a schematic side view, partly in section, of the actuator shown in FIG. 2, on an enlarged scale.

The upper mast part 19 can be extended and retracted relative to the lower mast part 18 to raise and lower the seat 12 by an electro-mechanical actuator 31 in a manner which will now be described with reference to FIGS. 2 and 5. The actuator 31 comprises upper and lower telescopically mounted body parts 32 and 33 respectively, a nut 34 secured to the upper end of the lower body part 33, a threaded rod 35 which co-operates with the nut 34, and a PMDC motor 36 which is secured to the upper body part 32 and which drives the threaded rod 35 through a reduction gearbox 37 to raise and lower the upper body part 32 relative to the lower body part 33. The upper and lower body parts 32 and 33 of the actuator are accommodated within the telescopic mast 11 and the motor 36 and reduction gearbox 37 are accommodated within a housing 38 attached to a bracket 8 on the collar 19*a*.

The lower end of the lower body part 33 is secured by a transverse pin 39 to a tubular boss 40 secured to the support plate 20 and the upper end of the upper body part 32 is secured by a transverse pin 41 to the collar 19*a* at the upper end of the upper mast part 19.

The lower mast part 18 has a part cylindrical bore 42 which communicates with a rectangular bore 43 defined within the flange 24. The upper mast part 19 is in the form of a cylindrical tube which is slidable in a bearing bush 44 fitted in the upper end of the lower mast part 18 and which has guide block 45 at its lower end. The guide block 45 is provided with bearing surfaces 46 and slides in the bore 43 of the flange 24 to support the lower end of the upper mast part 19 relative to the lower mast part 18 and to prevent relative angular displacement of the upper and lower mast parts.

A rechargeable battery pack 47 for powering the motor 36 is accommodated within a recess 48 in the housing 38 and is easily removable for recharging. The housing 38 accommodates relays (not shown) for operating the motor 36 and a current limiting device (also not shown) to cut off the power supply t the motor 36 when the mast 11 reaches fully extended and fully retracted positions.

A remote control switch 49 for operating the motor 36 is connected to the relays by a flexible connecting wire 50.

The apparatus described above is self-contained and can be placed in and removed from a bath at will. To position the apparatus in a bath the seat 12 may first be removed to make for ease of handling. The apparatus, less the seat, is then placed in the bath so that the suckers 16 and pads 17 make contact with the bottom inside surface of the bath. The base 10 is then pressed down so that the suckers 16 grip the bath securely. The seat is then attached to the mast 11.

The mast 11 is then extended by operating the actuator 31. As the motor 36 rotates in an appropriate direction to extend the mast, the threaded rod 35 rotates in the nut 34 and raises the upper body part 32 of the actuator relative to the lower body part 33. This in turn raises the upper mast part 19 relative to the lower mast part 18 and the seat 12 moves upwards. When the mast 11 has been extended to raise the seat to a level in which the side flaps 29 of the seat 12 rest on respective side ledges of the bath and bridge any gap between the seat 12 and the bath, power to the motor 34 is cut off. A physically disabled person can then sit on the seat 12, either with or without assistance, and swing his/her legs into the bath. The disabled person is then lowered into the bath by operating the motor 34 to retract the mast 11. As the seat 12 is lowered into the bath the side flaps 29 will hinge upwards. After bathing, the seat 12 is again raised as aforesaid.

When not in use, the apparatus can be left in the bath or, if desired, it can be removed. In order to remove the apparatus from the bath, the seat 12 is lifted off the mast after depressing the spring loaded button 26, the suckers 16 are then released by lifting the rear end of the base 10, and the apparatus is lifted clear of the bath by taking hold of the mast 11 and the base 10.

The embodiment described above is given by way of example only and various modifications will be apparent to persons skilled in the art without departing from the scope of the invention.

I claim:

1. Apparatus for assisting physically disabled persons into and out of a bath, comprising a base, means provided on the base for releasably gripping an inside bottom surface of a bath, a lifting column in the form of a telescopic mast having a lower mast part fixed to the base and an upper mast part which can be extended and retracted relative to the lower mast part, a seat supported by the upper mast part, an electrically powered actuator mounted with respect to the mast for extending and retracting the upper mast part relative to the lower mast part to raise and lower the seat relative to the base, and means for guiding the seat relative to the lower mast part as the upper mast part, together with the seat, is raised and lowered relative to the lower mast part.

2. Apparats as claimed in claim 1 wherein the actuator is an electromechanical actuator.

3. Apparatus as claimed in claim 1, wherein the seat is detachable from the lifting column.

4. Apparatus as claimed in claim 1, wherein the seat has at least one hinged side flap for extending to the side of the seat.

5. Apparatus as claimed in claim 1, further comprising gripping means for supporting the base on the inside bottom surface of the bath, wherein the gripping means comprises suckers.

6. Apparatus as claimed in claim 5, wherein the suckers each have a flap for releasing the sucker from gripping engagement with a surface.

7. Apparatus as claimed in claim 5, wherein the base is provided with two suckers and two non-gripping pads for supporting the base on the inside bottom surface of the bath.

8. Apparatus for assisting physically disabled persons into and out of a bath, comprising a base, means provided on the base for releasably gripping an inside bottom surface of the bath, a lifting column in the form of a telescopic mast having a lower mast part fixed to the base and an upper mast part which can be extended and retracted relative to the lower mast part, a seat supported by the upper mast part, and an electrically powered actuator comprising an electric motor mounted at or adjacent to an upper end of the upper mast part and a threaded rod and nut arrangement within the mast, the threaded rod and nut being rotatable relative to one another by the electric motor.

9. Apparatus for assisting physically disabled persons into and out of a bath, comprising a base, means provided on the base for releasably gripping an inside bottom surface of a bath, a lifting column fixed to the base, a seat supported by the lifting column, an electrically powered actuator mounted with respect to the lifting column for raising and lowering the seat relative to the base, and a rechargeable battery pack for powering the actuator, the battery pack being removably mounted for recharging purposes at or adjacent to an upper end of the lifting column.

10. Apparatus for assisting physically disabled persons into and out of a bath, comprising a base, two suckers and two non-gripping pads on the base for supporting the base on an inside bottom surface of a bath, a lifting column fixed to the base, a seat supported by the lifting column, and an electrically powered actuator mounted with respect to the lifting column for raising and lowering the seat relative to the base, each sucker having a flap connecting a rim portion of the sucker to the base of the apparatus so that the sucker can be released from gripping engagement with the bath surface by raising the non-gripping pads clear of the bath surface.

* * * * *